United States Patent [19]

Couch

[11] 4,031,589

[45] June 28, 1977

[54] PORTABLE DRIP COLLECTOR

[76] Inventor: Robert L. Couch, Rte. 3, Box 583, Harriman, Tenn. 37748

[22] Filed: Apr. 21, 1976

[21] Appl. No.: 678,746

[52] U.S. Cl. ..... 15/248 R; 15/248 A; 30/136

[51] Int. Cl.[2] ..... B05C 17/02; B05C 21/00

[58] Field of Search ..... 15/115, 116 R, 120 A, 15/247, 248 R, 248 A; 30/136, 136.5; 248/99, 100; 401/15

[56] References Cited

UNITED STATES PATENTS

| | | | |
|---|---|---|---|
| 2,820,290 | 1/1958 | Porter | 30/136 |

FOREIGN PATENTS OR APPLICATIONS

| | | | |
|---|---|---|---|
| 1,072,052 | 3/1954 | France | 15/236 R |
| 51,395 | 4/1890 | Germany | 30/136 |
| 263,177 | 8/1913 | Germany | 30/136 |
| 337,333 | 5/1921 | Germany | 15/116 R |
| 612,551 | 4/1935 | Germany | 30/136 |

*Primary Examiner*—David Blum
*Attorney, Agent, or Firm*—Martin J. Skinner

[57] ABSTRACT

A device for intercepting droplets produced by ceiling-engaging sponges, rollers and the like is described. This portable drop cloth has a light weight framework which supports either a flat plastic sheet or a plastic bag, whichever is preferred for specific applications. The framework is attached to a collar-like member so that the unit may be positioned at a desired location along a handle of the ceiling-engaging element. In some embodiments the size of the frame, and its angular position with respect to the handle to which it is attached, may be adjusted.

9 Claims, 6 Drawing Figures

PORTABLE DRIP COLLECTOR

BACKGROUND OF THE INVENTION

The subject development relates generally to means for catching spatter or drips from devices used for overhead cleaning or painting, and more particularly to a "drop cloth" which moves with the devices for overhead applications.

The use of rollers for the application of paint to all surfaces, and particularly to ceilings, has become very common place. Such are often used even for commercial and industrial buildings. Although paints are formulated to minimize drips and spatter, some does occur. In instances where this would be detrimental to finished floors, equipment or merchandise, a drop cloth is employed to cover such surfaces and materials. In large installations this precaution involves considerable extra labor and the use of many drop cloths.

Another overhead operation that creates an even higher degree of spatter or drips is the cleaning of a ceiling with a solution-containing sponge or the like. The surplus solution cannot easily be handled with drop cloths; thus, the region below that being cleaned must be cleared of equipment, merchandise, etc.

Attachments have been provided in the prior art to be placed in close proximity of paint rollers to minimize spatter. Typical of these attachments are illustrated by U. S. Pats. Nos. 2,817,868, 2,896,244, 3,112,729, 3,319,279 and 3,538,532. These may be of use for limited painting areas; however, they would be relatively ineffective when painting large areas due to the accumulation of the paint. Also, they prevent insertion of the roller in a paint bucket as is conventional for industrial painting. Such devices are completely ineffective for use with a cleaning pad.

SUMMARY OF THE INVENTION

My invention is a portable drop cloth for releasible attachment to the handle or handle extension of a paint roller, cleaning pad or the like which includes a frame, means for attaching the frame at a desired position along the handle or handle extension, and a disposable drip collector releasibly attached to the frame.

DETAILED DESCRIPTION

Figure 1:
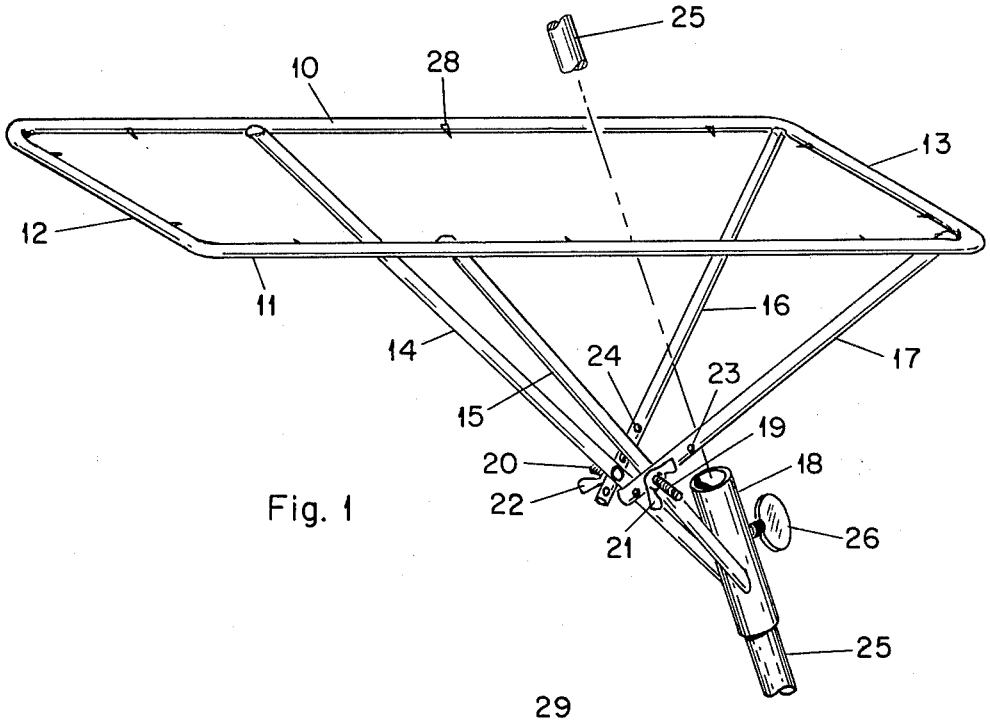
FIG. 1 is an isometric view of a frame for a typical embodiment of a portable drop cloth I have developed to overcome the above-stated problems.

My invention is best described with reference to the figures. The structural portions of one embodiment of the device are shown in FIG. 1. A rectangular frame is formed with sides 10, 11 and ends 12, 13. This frame may be formed from a single length of rod or bar with the mating ends joined as by welding. Alternatively, a plurality of pieces may be permanently joined or may be connected with slip fittings (not shown) to permit disassembly or a change in size. Typically, the frame may be fabricated from round aluminum rod about ¼ inch (6.5 mm) in diameter. The dimensions of the rectangular frame may be, for example, 16 × 24 inches (40 × 60 cm). None of these dimensions, however, are considered to be limiting values.

Extending downwardly from the frame are four brace members 14-17. One end of each brace member is connected to the frame and the second end of two brace members 14, 15 is joined to a collar 18. The second ends of the other brace members 16, 17 are releasibly attached to the first brace members using, for example, bolts 19, 20 and wing nuts 21, 22. A plurality of holes 23, 24 through brace members 16, 17 provide for an adjustment of these braces and thus vary the angle between the plane of the frame and the axis of collar 18. Alternatively, the second ends of brace members 16, 17 may be attached to collar 18. The brace members 14–17 may be fabricated from material corresponding to that of the frame.

The purpose of collar 18 is to grasp a handle 25 passing axially therethrough. The handle 25 may be that attached to a paint roller, cleaning pad or the like (not shown), or may be an extension to the handle. As such, the collar 18 may be a complete cylinder as shown with a set screw 26 passing through the wall thereof to engage the handle 25. This permits adjusting the collar 18 along the handle 25 whereby the unit may be positioned at a desired distance from a painting or cleaning element at the end of the handle 25.

Figure 2:
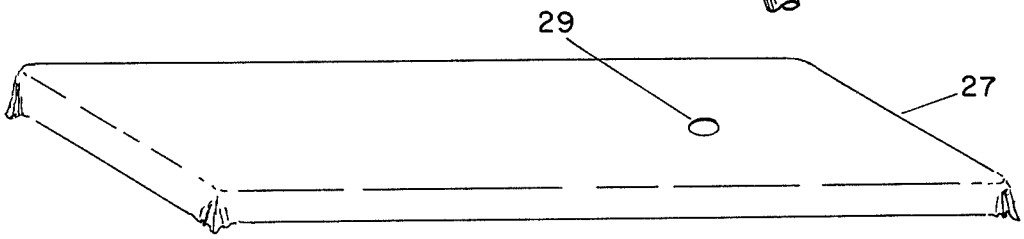
FIG. 2 illustrates a substantially flat surface to be affixed to the frame of FIG. 1 of principal value to catch splatter from a painting roller.

Referring now to FIG. 2, shown therein is a disposable "catcher" 27 to be attached to the frame of FIG. 1. This catcher is a substantially flat sheet of plastic, e.g., polyethylene, or other solution-retaining material, that is stretched over the frame and releasibly attached thereto with, for example, paper adhesive (masking) tape. Alternatively, the film may be wrapped about the frame members 10–13 and impaled on spike-like projections 28 (FIG. 1). The catcher 27 is provided with an aperture 29 to permit penetration by the handle 25. The aperture may be a slot (not shown) to accommodate the handle at different angles between the frame and handle. The catcher 27 of this FIGURE is of use particularly for overhead paint applications.

Figure 3:
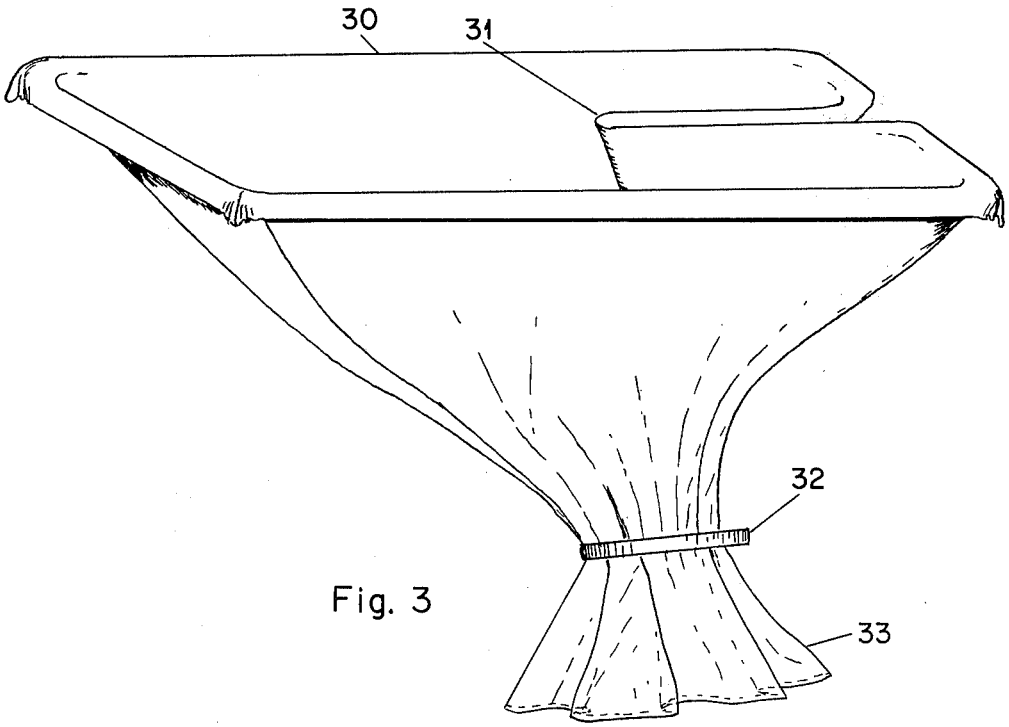
FIG. 3 illustrates a bag-type catcher to be affixed to the frame of FIG. 1 of principal value to collect drips from a cleaning pad.

FIG. 3 illustrates an embodiment of particular use for overhead cleaning applications where, for example, a solution-soaked pad is used. Typical of such pads is a swivel cleaning sponge sold under the name "Doodle Bug" and manufactured by the 3-M Company. For this use (and others where there is a substantial excess of liquid) a bag-type catcher 30 is employed. As in the flat catcher of FIG. 2, catcher 30 is attached to the frame with pape adhesive tape or the like. Rather than provide a penetration through the bag for the handle 25, the catcher 30 is wrapped around the handle, as illustrated at 31. The catcher 30 is then loosely gathered to the handle below the frame with a piece of paper adhesive tape 32, a tie string or other means. This creates a reservoir portion 33 which, due to gravity prevents inadvertent release of accumulated fluid even when a cleaning pad is dipped into a container of cleaning solution.

Figure 4:
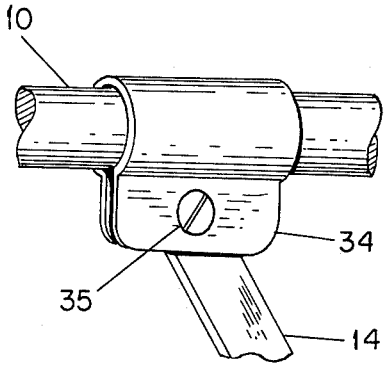
FIG. 4 is a drawing illustrating an alternative method of joining braces to the frame of FIG. 1.

Several variations of the construction are visualized for specific purposes. For example, it may be desirable to collapse the frame and brace members. This may be accomplished with the construction of FIG. 4. Brace member 14, for example, is attached to frame side member 10 with a U-shaped clamp 34 that encircles member 10. A threaded fastener 35, e.g., a bolt and nut, passes through the clamp 34 and brace 14 whereby tightening thereof causes the clamp 34 to grasp member 10 to prevent relative movement therebetween. However, brace 14 may be pivoted about fastener 35 to fold it toward member 10. The ends of other brace members would be similarly attached to frame members.

Figure 5:
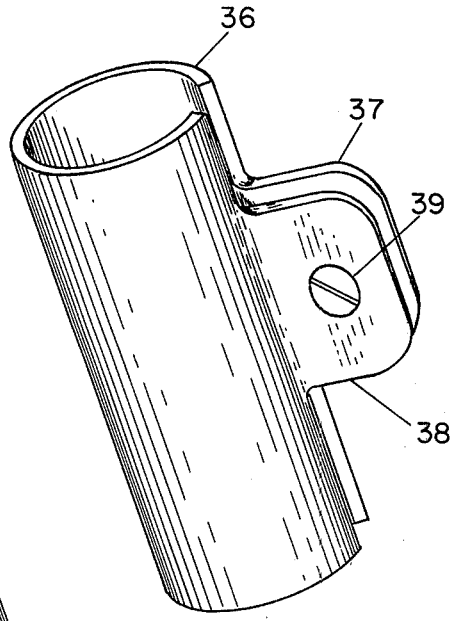
FIG. 5 is a drawing illustrating an alternative type of collar for engaging a handle.

Another means of attaching my portable drop cloth to a handle is illustrated in FIG. 5. In this embodiment, I utilize a split collar 36. Collar 36 is provided with a pair of substantially parallel radial projections 37, 38. A threaded fastener 39 passing through these projections may be tightened to draw the projections toward each other and thereby clamp the collar 36 to a handle.

Figure 6:
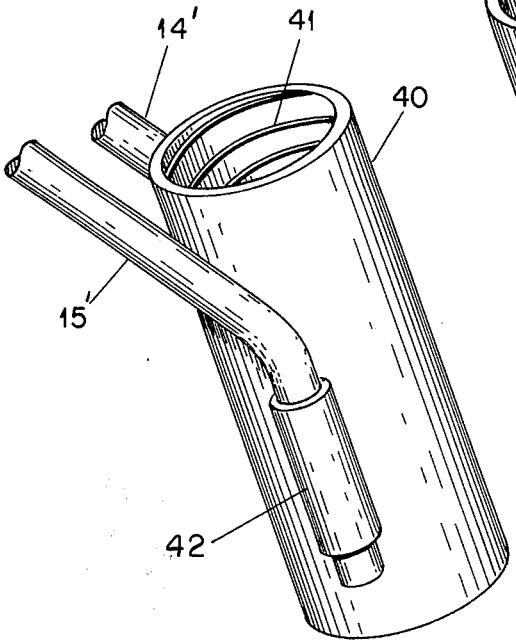
FIG. 6 is a drawing illustrating another alternative type of collar for engaging a handle.

Illustrated in FIG. 6 is another embodiment of a collar member for attachment to a handle. In this embodiment a continuous collar 40 is provided with internal threads 41, these threads being the same type as conventionally utilized on handles for paint rollers and the like. Thus, a long handle may be inserted into the bottom of collar 40 and a handle extension into the top of collar 40 to give proper length whereby a user may stand on the floor during applications of materials on relatively high ceilings.

In FIG. 6 I also show an alternative method of joining brace members 14, 15 to collar 40. This is accomplished by providing a pair of sleeves 42 (one shown) of sufficient diameter to accept the lower ends of brace members 14', 15' in frictional engagement. The sleeves 42 are attached to, or integral with, collar 40. This construction, also, is of value in an embodiment that can be easily disassembled for packaging, transporting between sites, etc.

The constructions described above permit my invention to be used for several overhead operations. For example, using the frame of FIG. 1 and the catcher of FIG. 2, overhead painting may be performed even in areas where important equipment and/or merchandise is present as in markets, service stations or the like. For this type of painting, a paint roller is normally attached to an extension handle whereby the painter may work from the floor level. My portable drop cloth is positioned along the handle, by adjusting the collar, at a distance from the roller to provide optimum freedom of roller access to areas to be painted and effective catching of spatter and drips. In general, the roller will be above the approximate center of the frame. The braces of the frame are, in turn, adjusted to orient the catcher in a generally horizontal position during paint application. The roller may then be dipped into a paint container and the excess paint removed on a perforated grid in a normal manner prior to applying the paint to a ceiling or other overhead location.

My invention is also of use for the overhead cleaning of surfaces using a fiber- or sponge-coated pad at the end of a long handle. As above, the frame is mounted on the handle at a desired position and at a desired angular orientation. The bag-type catcher of FIG. 3 may be used since a larger quantity of solution splatter and drip is expected during a cleaning operation. The cleaning pad may be dipped in a container of solution, the excess removed and then used for cleaning without removing my portable drop cloth from the handle. At any time the collected cleaning solution becomes excessive, the bag may be inverted over the container of solution or a disposal drain.

From the foregoing, it may be seen that my invention provides significant protection to furniture, equipment, merchandise, etc., during overhead cleaning or painting. This protection is afforded without the deployment of large drop cloths, removal of potentially damaged material or any of the other time consuming acts previously required in business houses, etc. This degree of protection is not provided by the devices of the prior art. Although the above-cited illustrations are limited to use with a paint roller or cleaning pad, my portable drop cloth will be of value in other overhead operations such as scraping of loose paint or plaster, dusting, etc.

Although aluminum may be a preferred material for use in the frame components, other suitable materials would include many of the rigid plastics such as polyvinylchloride. The construction shown in FIG. 6 is particularly amenable to fabrication from the rigid plastics.

I claim:

1. A portable drip collector for releasible attachment to a handle of a tool for overhead manipulation, which comprises: a rectangular hoop; a collar to receive the handle; a first and second pair of brace arms connecting the hoop to the collar, the first pair of arms each having one end connected to opposite sides of the hoop, the second pair of arms each having one end connected to corners of one end of the hoop; handle engaging means associated with the collar to releasibly engage the handle, and a disposable sheet collector fastened to and spanning the hoop.

2. The drip collector of claim 1 wherein the second end of the first pair of arms are connected to the collar and the second end of the second pair of arms are connected to the first pair of arms.

3. The drip collector of claim 1 wherein the collector is substantially flat and is provided with an aperture for the passage of the handle therethrough.

4. The drip collector of claim 1 wherein the collector is baglike having an upper open end joined to the hoop and a closed lower end, and bag having means attached thereto for loosely gathering together a central portion thereof against the handle.

5. The drip collector of claim 2 wherein the second pair of arm members are provided with adjustment means.

6. The drip collector of claim 2 wherein the end of each arm joined to the hoop is connected thereto with a pivot.

7. The drip collector of claim 2 wherein the collar is a complete cylinder and the handle engaging means is a threaded member passing radially through the collar.

8. The drip collector of claim 2 wherein the collar is provided with a longitudinal slit along its length, a pair of projections extending radially from the collar, one projection on each side of the slit, and a threaded fastener passing through both projections.

9. The drip collector of claim 2 further comprising a plurality of sharpened hooks attached to the hoop, the collector being joined to the hoop by engagement with the hooks.

* * * * *